US005852833A

United States Patent [19]

Gregoire

[11] Patent Number: 5,852,833

[45] Date of Patent: Dec. 29, 1998

[54] TOILET SEAT LIFTING DEVICE HAVING HIS AND HER FOOT PEDAL

[76] Inventor: Julius Gregoire, 5616 Shrimpers Row, Dulac, La. 70353

[21] Appl. No.: 942,315

[22] Filed: Oct. 1, 1997

[51] Int. Cl.[6] ..... A47K 13/10

[52] U.S. Cl. ..... 4/246.3

[58] Field of Search ..... 4/246.1, 246.3, 4/246.4, 246.5

[56] References Cited

U.S. PATENT DOCUMENTS

| | | | |
|---|---|---|---|
| 3,528,075 | 9/1970 | Leon | 4/246.5 |
| 4,030,146 | 6/1977 | Pilkington et al. | 4/246.5 |
| 4,584,724 | 4/1986 | Wilson | 4/246.5 |
| 5,075,906 | 12/1991 | Robbins | 4/246.5 |
| 5,448,782 | 9/1995 | Patajac | 4/246.5 |
| 5,594,958 | 1/1997 | Nguyen | 4/246.5 |

*Primary Examiner*—Robert M. Fetsuga
*Attorney, Agent, or Firm*—Joseph N. Breaux

[57] ABSTRACT

A toilet seat lifting device having a his and her foot pedal which allows a toilet seat to be automatically raised or lowered, regardless of the posture of the bathroom user, without using hands. More specifically, the his and her foot pedal is conveniently positioned and uniquely designed to enhance the application of foot pressure thereto as a gentleman stands directly in front of the toilet and as a woman squats down over the toilet bowl wherein the application of foot pressure serves to automatically raise a toilet seat and the release of the foot pressure serves to automatically lower the toilet seat.

17 Claims, 2 Drawing Sheets

TOILET SEAT LIFTING DEVICE HAVING HIS AND HER FOOT PEDAL

TECHNICAL FIELD

The present invention relates to toilet seat lifting devices and, more particularly, to a toilet seat lifting device having a his and her foot pedal which allows a toilet seat to be automatically raised or lowered, regardless of the posture of the bathroom user, without using hands. More specifically, the his and her foot pedal is conveniently positioned and uniquely designed to enhance the application of foot pressure thereto as a gentleman stands directly in front of the toilet and as a woman squats down over the toilet bowl wherein such application of foot pressure serves to automatically raise a toilet seat and the release of such foot pressure serves to automatically lower the toilet seat.

BACKGROUND OF THE INVENTION

Typically, when men use the bathroom, they raise the toilet seat in a vertical position so that the urine stream does not engage such toilet seat thereby maintaining such toilet seat clean of urine. However, after using the toilet, oftentimes, the toilet seat is not lowered to its normally intended position (horizontal) for the next user such as a woman. In the convenience of their own home, women typically sit on the toilet seat at least when urinating. Therefore, several devices have been patented to allow men to automatically raise or lower the toilet seat without using their hands. Some of such devices have been described in U.S. Pat. No. 5,594,958, by Nguyen, entitled "HANDS-OFF TOILET SEAT LIFTING APPARATUS"; U.S. Pat. No. 5,448,782, by Ratajac, entitled "FOOT ACTUATED TOILET SEAT LIFTING DEVICE"; U.S. Pat. No. 5,075,906, by Robbins, entitled "SEAT LIFTER"; U.S. Pat. No. 4,584,724, by Wilson, entitled "TOILET SEAT LIFTING AND LOWERING DEVICE"; U.S. Pat. No. 4,030,146, by Pilkington et al., entitled "TOILET SEAT LIFTING APPARATUS INCLUDING A RESILIENT BOWED MEMBER FOR PREVENTING THE SEAT FROM SLAMMING"; and, U.S. Pat. No. 3,528,075, by Leon, entitled "DEVICE FOR RAISING THE SEAT OF A CLOSET."

The unsanitary conditions found in commercial bathrooms require women to also lift the toilet seat and squat down to position themselves over the toilet bowl. Therefore, when using the toilet, women must use their hands to raise the toilet seat prior to using the toilet which exposes their hands to bacteria and/or diseases. While prior toilet seat lifting devices function to lift toilet seats, such prior toilet seat lifting devices do not accommodate the foot position as women squat down to position themselves over the toilet bowl.

The foot pedals of the prior toilet seat lifting devices have numerous drawbacks even for male actuation. Since the foot pedal actuation to raise and lower the toilet seat requires that the foot pressure must remain on the foot pedal to maintain the toilet seat in the raised position, the placement of the foot pedal to the side of the toilet therefore has significant drawbacks. For example, the foot pedals positioned on the side of the toilet bowl do not extend far enough beyond the front of the toilet bowl. Henceforth, to raise the toilet seat, a gentleman must stand very close to the toilet bowl with one foot applying pressure to the foot pedal along the side of the toilet. However, gentlemen normally stand directly in front of the toilet with both legs substantially even. As a result, the projection of the urine stream may extend beyond the toilet rim unless care is taken to maintain the urine stream in the toilet bowl. Furthermore, the foot pedal is oftentimes awkward to reach especially in small confining stalls or bathrooms wherein the leg is cramped in order to reach the foot pedal.

Nevertheless, the foot pedals of known toilet seat lifting devices are not designed or positioned to accommodate foot pressure to be applied thereto when a person is squatting over the toilet bowl, such as some women do in commercial bathrooms or otherwise.

It can be readily seen that there exists the continuing need for a toilet seat lifting device having a his and her foot pedal which allows a toilet seat to be automatically raised or lowered, regardless of the posture of the bathroom user, without using hands. More specifically, there exists a continuing need for a his and her foot pedal conveniently positioned and uniquely designed to enhance the application of foot pressure thereto as a gentleman stands directly in front of the toilet and as a woman squats down over the toilet bowl wherein such application of foot pressure serves to automatically raise a toilet seat and the release of such foot pressure serves to automatically lower the toilet seat.

SUMMARY OF THE INVENTION

The preferred embodiment of the toilet seat lifting device of the present invention solves the aforementioned problems in a straight forward and simple manner. What is provided is a toilet seat lifting device having a his and her foot pedal which allows a toilet seat to be automatically raised or lowered, regardless of the posture of the bathroom user, without using hands. More specifically, the his and her foot pedal is conveniently positioned and uniquely designed to enhance the application of foot pressure thereto as a gentleman stands directly in front of the toilet and as a woman squats down over the toilet bowl wherein such application of foot pressure serves to automatically raise a toilet seat and the release of such foot pressure serves to automatically lower the toilet seat.

The toilet seat lifting device of the present invention for lifting a toilet seat of a toilet, for use by men and women, generally comprises: a foot pedal having a first bar member recessed under the front of a toilet bowl of the toilet and an arch-shaped member coupled to said first bar member wherein said arch-shaped member extends beyond the toilet bowl a sufficient distance accessible by a foot of a bathroom user and is offset to the side from the center of the front of the toilet; a first support frame member coupled to said arch-shaped member; a second support frame member parallel to said first support frame member a n d perpendicularly coupled to said first bar member; and, lifting arm member coupled to said toilet seat and to said first support frame member.

In view of the above, an object of the present invention is to a toilet seat lifting device having a his and her foot pedal which extends beyond the front of the toilet to accommodate the normal standing posture of males in front of the toilet and the squatting posture of a woman or a man over the toilet bowl so that bacteria or other unsanitary elements are not contacted.

Another object of the present invention is to provide a toilet seat lifting device having a his and her foot pedal which serves to raise the toilet seat when foot pressure is applied thereto and to lower the toilet seat as such foot pressure is removed thereby eliminating the need to touch the toilet seat when the bathroom user desires to lift such toilet seat.

A further object of the present invention is to provide to a his and her foot pedal comprising a first bar member recessed under the front of the toilet bowl and an arch-shaped portion coupled to said first bar member wherein said arch-shaped portion extends beyond the front of the toilet seat such that the interior of the arch-shaped portion accommodates therein at least a portion of the foot of a woman or a man when squatting down over the toilet bowl; and wherein, as foot pressure is applied to such arch-shaped portion, the toilet seat is raised and as foot pressure is removed such toilet seat is lowered.

It is a still further object of the present invention to provide a his and her foot pedal comprising an arch-shaped portion extending beyond the front of the toilet bowl a sufficient distance from the front of the toilet bowl which serves to 1) allow a gentleman to stand directly in front of the toilet bowl with both feet essentially parallel while one foot applies a force of pressure on the foot pedal to raise the toilet seat; and 2) to allow a woman or a man to squat down over the toilet bowl in a normal manner and apply a force of pressure on the foot pedal for raising and maintaining the toilet seat in a raised generally vertical position.

It is a still further object of the present invention to provide a toilet seat lifting device which maximizes the rotation of the toilet seat to an essentially vertical position so that the raised toilet seat does not touch the woman's or man's back end as they squat and allows the raised toilet seat to be lowered by gravitational forces acting thereon when the foot is removed from the his and her foot pedal.

In view of the above, a feature of the present invention is to provide a toilet seat lifting device which is easy to install.

Another feature of the present invention is to provide a toilet seat which is simple to use by both men and women.

A further feature of the present invention is to provide a toilet seat which is relatively simple structurally an mechanically.

It is a still further feature of the present invention to a toilet seat lifting device which is inexpensive and simple to manufacture.

The above objects and other features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
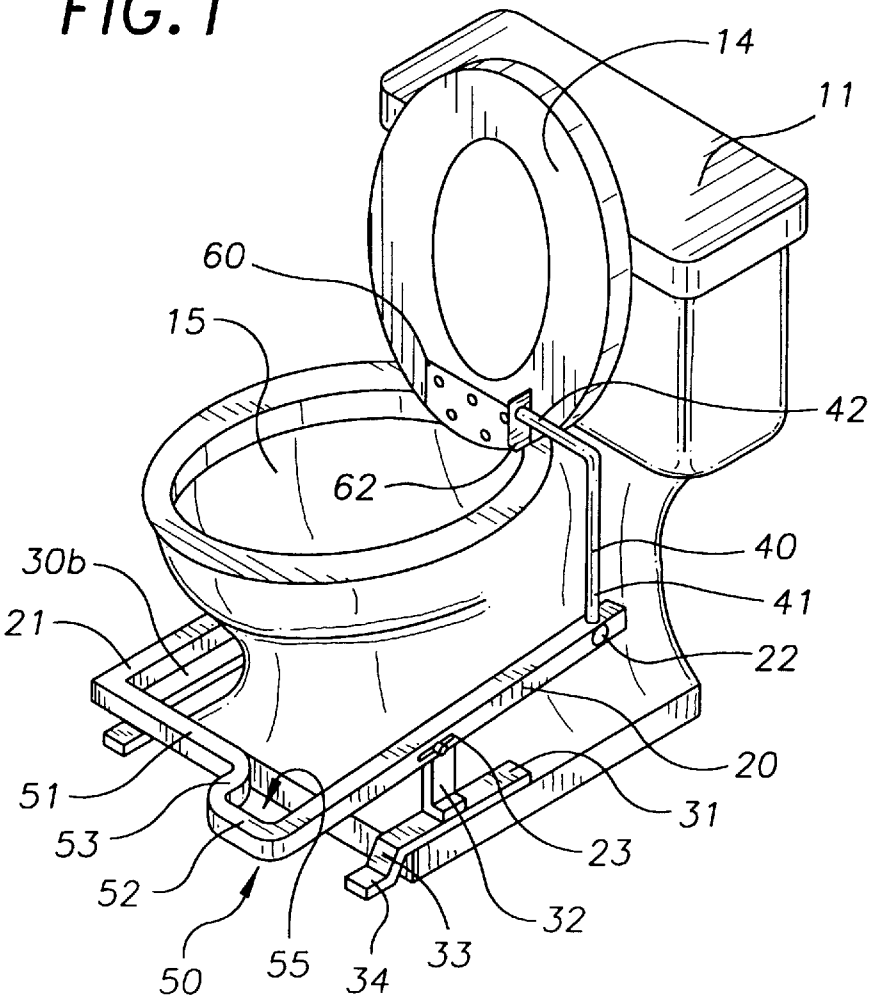
FIG. 1 illustrates a side perspective view of the preferred embodiment of the toilet seat lifting device of the present invention with the toilet seat in the raised position.
Figure 4:
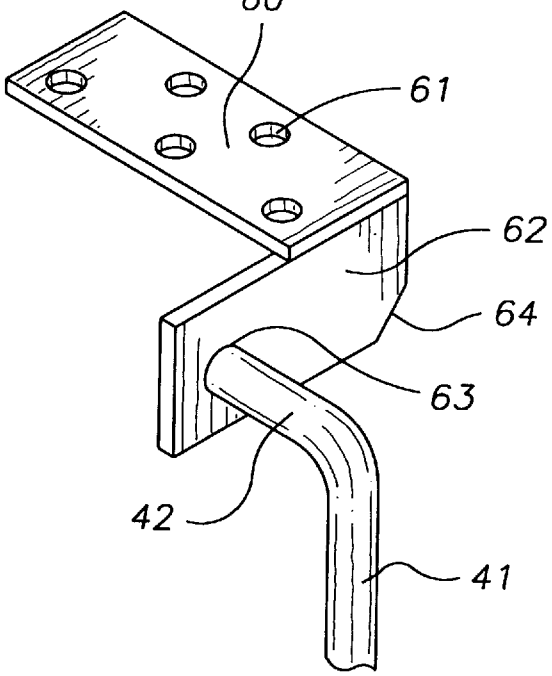
FIG. 4 illustrates the plate, bracket member and the lifting arm of the toilet seat lifting device of the present invention in the non-lifting position.

Referring now to the drawings, and in particular FIG. 1, a side perspective view of the preferred embodiment of the toilet seat lifting device of the present invention with toilet seat 14 in the raise position is illustrated. The toilet seat lifting device of the present invention is designated generally by the numeral 10. Toilet seat lifting device 10 is mounted on the sides of toilet 11 wherein a portion of his and her foot pedal 50 is recessed under toilet bowl 15 and a portion to the side of toilet bowl 15 projects beyond the front of toilet bowl 15. Toilet 11 has hingely coupled thereto a toilet cover and toilet seat 14. In operation, toilet seat lifting device serves to lift toilet seat 14 when toilet cover is in its resting position against the back of the toilet and serves to lift the toilet seat 14 and the toilet cover when both are in the lowered position.

The toilet seat lifting device 10 is generally comprised of first and second support frame members 20 and 21, first and second stanchion members 30*a* and 30*b*, lifting arm 40, his and her foot pedal 50, and plate 60.

Toilet 11, as shown, comprises flanged base 16 coupled to the floor of a bathroom (not shown). Flanged base 16 has a height and a width for supporting on each side thereof first and second stanchion members 30*a* and 30*b*, respectively. Since, first and second stanchion members 30*a* and 30*b* are identical, only one such stanchion member will be described in detail.

First stanchion member 30*a* comprises flat bar member 31 parallel to the floor having coupled in the center thereof the bottom end of support leg 32. The top end of support leg 32 has coupled thereto first support frame member 20. Flat bar member 31 has one end portion 33 curved downward toward the floor wherein such curved portion 33 further curves into a foot portion 34 wherein foot portion 34 is parallel to and rests on the floor.

The curved portion 33 and foot portion 34 serve to support flat bar member 31 above the floor a predetermined distance wherein such distance allows flat bar member 31 to rest on the side of flange base 16. Alternatively, in lieu of support flat bar member 31 resting on flange base 16, the other end of flat bar member 31 may be provided with a curved portion 33 and foot portion 34 thereby flange base 16 may be eliminated.

First support frame member 20 is positioned on one side of the toilet bowl 15 and second support fame member 21 is positioned on the other side of toilet bowl 15 wherein first and second support frame members 20 and 21 are parallel to the floor when in the non-lifting position. First support frame member 20 and second support frame member 21 are identical except that first support frame member 20 has a longer length than second support frame member 21 and second support frame member 21 does not have coupled thereto lifting arm 40, in the preferred embodiment. Nevertheless, second support frame member 21 may have a second lifting arm identical to lifting arm 40, if desired.

First support frame member 20 has coupled to one end thereof lifting arm 40 via pivot pin 22. First support frame member 20 extends beyond the front of toilet bowl 15 of toilet 11. First support frame member 20 has formed therein pivot slot 23 slightly offset from the center thereof wherein the elongation of pivot slot 23 extends in the horizontal plane. Support leg 32 has pivotally coupled thereto first support frame member 20 via pivot rod 24 coupled in pivot slot 23 wherein first support frame member 20 pivots about pivot rod 24 in a seesaw-like manner.

The horizontal elongation of pivot slot 23 allows support leg 32 to be shifted forwardly to ensure foot portion 34 rests on the floor and is not obstructed by flange base 16.

Figure 2:
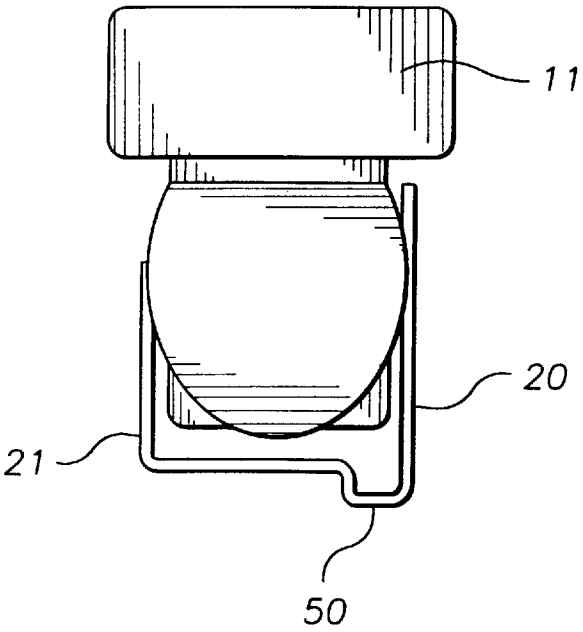
FIG. 2 illustrates a top view of the toilet seat lifting device of FIG. 1 having the toilet seat and toilet cover in the lowered position.

His and her foot pedal 50 comprises first bar member 51 perpendicularly coupled to second support frame member 21 wherein first bar member 51 is recessed under toilet bowl 15 of toilet 11. His and her foot pedal 50 further comprises second bar member 52 perpendicularly coupled to first support frame member 20 and third bar member 53 perpendicularly coupled to first and second first bar members 51 and 52. Second bar member 52 is distanced from first bar member 51 by the length of third bar member 53. Therefore, second bar member 52 is in front of toilet bowl 15 a sufficient distance accessible by the front of the foot of a bathroom user regardless of their posture when using toilet 11. As can be seen, his and her foot pedal 40 has an arch-shaped portion defined by first frame member 20 and second and third bar members 52 and 53. Such arch-shaped portion coupled to said first bar member 51 extends beyond the front of toilet bowl 15, as best seen in FIG. 2.

The interior 55 of the arch-shaped portion serves to accommodate therein at least a portion of the foot of a woman when squatting or any other person squatting wherein as foot pressure is applied to such arch-shaped portion the toilet seat is raised and as foot pressure is removed such toilet seat is lowered. More specifically, the hollow interior of arch-shaped portion allows the heal of a foot or a shoe to be placed therein.

Optimally, foot pressure should be applied to second bar member 52 with the toes or the front portion of the foot regardless of the posture of the bathroom user. Nevertheless, foot pressure may be applied to any bar member of his and her foot pedal 50. The recessed first bar member 51 does not compromise or obstruct the use of toilet 11 in any other manner. For example, in home use, toilet seat 14 may only need to be raised when a gentleman stands directly in front of toilet 11. Therefore, the recessed first bar member 51 is not in the way of any other bathroom user's feet when sitting on toilet seat 14. As can be seen, his and her foot pedal 50 comprising an arch-shaped portion extending beyond the front of toilet bowl 15 a sufficient distance from the front of toilet bowl 15 and to the side offset from the center of the front of the toilet serves to 1) allow a gentleman to stand directly in front of toilet bowl 15 with both feet essentially parallel while one foot applies a force of pressure on his and her foot pedal 50 to raise toilet seat 14; and 2) to allow a woman or a man to squat down over toilet bowl 15 in a normal manner and apply a force of pressure on his and her foot pedal 50 for raising and maintaining toilet seat 14 in a raised generally vertical position.

Lifting arm 40 comprises an elongated shaft member 41 having one end rotatably coupled to first support frame member 20 via pivot pin 22 and the other distal end has perpendicularly coupled thereto extension shaft member 42.

Plate 60 comprises a planar member having a plurality of apertures 61 formed therein wherein each aperture 61 receives therein a securing means (not shown) such as, a screw, for securing plate 60 to the under side of toilet seat 14 of toilet 11. One edge of the planar member has coupled thereto bracket member 62.

Figure 3:
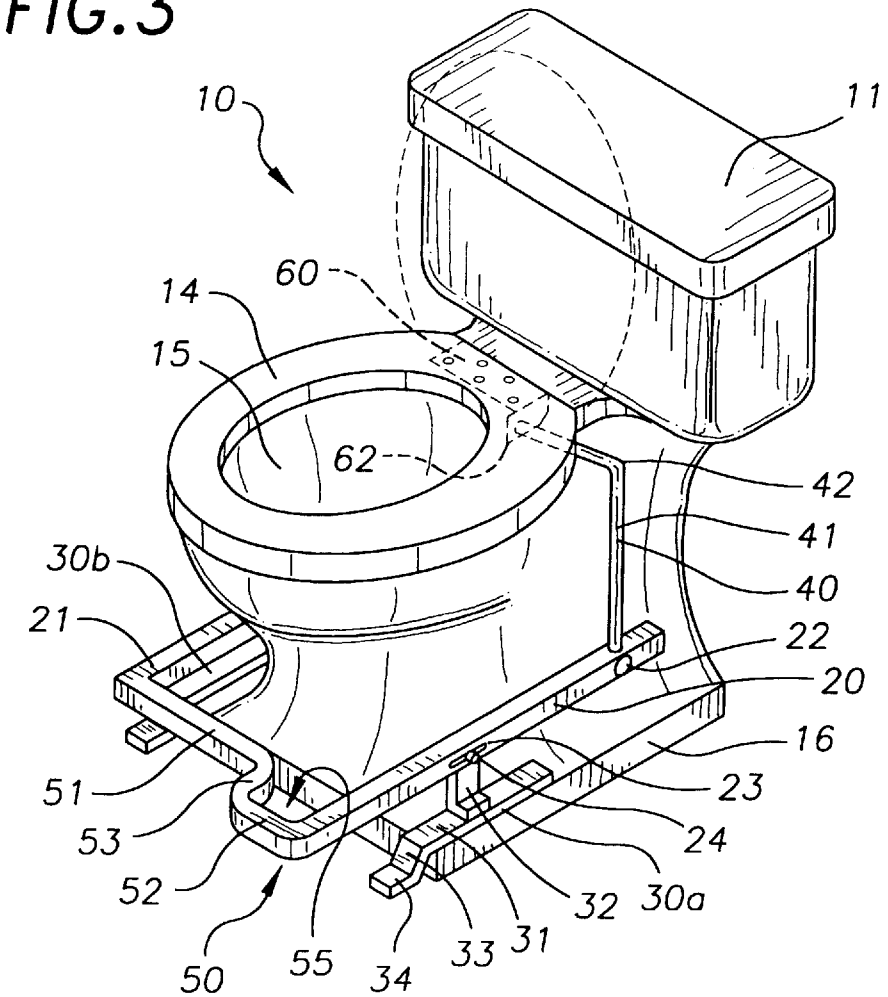
FIG. 3 illustrates a side perspective view of the preferred embodiment of the toilet seat lifting device of the present invention with the toilet seat in the lowered position.

Bracket member 62 is a rectangular shaped member capable of extending in the gap between the under side surface of toilet seat 14 and the rim of the toilet bowl 11. Bracket member 62 is rotatably coupled to extension shaft member 42 via aperture 63 wherein, in the non-lifting position, bracket member 62 is substantially parallel to the horizontal plane, as best seen in FIG. 3 and in the raised position, bracket member 62 is substantially parallel to the vertical plane and to elongated shaft member 41. Bracket member 62 has four corners wherein one corner 64 along an edge not coupled to plate 60 is truncated to allow for the unhindered lifting of toilet seat 14, as toilet seat 14 is lifted by the upward movement of lifting arm 40. As toilet seat 14 rotates, corner 64, if not truncated, might abut against the surface of the back of the toilet rim and hinder the full rotation of toilet seat 14 into its raised position.

Referring now to FIG. 3, as foot pressure is applied to second bar member 52 of his and her foot pedal 50 or any other bar member of his and her foot pedal 50, the foot pressure serves to urge the front portion of first support frame member 20 downward and the back portion of first support frame member 20 upward in a seesaw-like manner. Likewise, the front portion of second support frame member 21 is urged downward and the back portion of second support frame member 21 is urged upward as foot pressure is applied to his and her foot pedal 50. As the back portion of first support frame member 20 pivots upward, lifting arm 40 applies an upward force of pressure to toilet seat 14 wherein bracket member 62 rotates about extension shaft member 42 into a generally vertical position and elongated shaft member 41 of lifting arm 40 is in a substantially vertical position. Thereby, toilet seat 14 is rotated from the lower position to the raised position.

The back portion of first support frame member 20 has a sufficient length to maximize the rotation of toilet seat 14 such that toilet seat 14 is almost in a vertical position. However, toilet seat 14 does not fully rotate to the vertical position or beyond. Thereby, gravitational forces to acting on toilet seat 14 serve to rotate toilet seat 14 in the lowered position, as the foot pressure is removed. Henceforth, toilet seat lifting device 10 serves to automatically raise and lower toilet seat 14.

The essentially vertical position of toilet seat 14 serves to prevent the raised toilet seat 14 from touching the women's or man's back end as they squat down over toilet bowl 15 and allows the raised toilet seat 14 to be lowered by gravitational forces acting thereon when the foot is removed from his and her foot pedal 15.

It can be seen from the preceding description that a toilet seat lifting device 10 having a his and her foot pedal 50 which allows toilet seat 15 to be automatically raised or lowered, regardless of the posture of the bathroom user, without using hands has been provided. More specifically, what has been provided is a his and her foot pedal 50 which is conveniently positioned and uniquely designed to enhance the application of foot pressure thereto as a gentleman stands directly in front of the toilet and as a woman or a man squat down over the toilet bowl wherein such application of foot pressure serves to automatically raise a toilet seat and the release of such foot pressure serves to automatically lower the toilet seat.

It is noted that the embodiment of the toilet seat lifting device described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A toilet seat lifting device for lifting a toilet seat of a toilet, for use by men and women, comprising:

a foot pedal having a first bar member recessed under the front of a toilet bowl of the toilet and an arch-shaped member coupled to said first bar member wherein said arch-shaped member extends beyond the toilet bowl a sufficient distance accessible by a foot of a bathroom user and is offset to the side from the center of the front of the toilet;

a first support frame member coupled to said arch-shaped member;

a second support frame member parallel to said first support frame member and perpendicularly coupled to said first bar member; and, a lifting arm member coupled to said toilet seat and to said first support frame member.

2. The toilet seat lifting device of claim 1, said arch-shaped member comprises:

a second bar member perpendicularly coupled to said first support frame member; and, a third bar member perpendicularly coupled to said first and second bar members wherein said second bar member is distanced from said first bar member by the length of said third bar member and wherein said second bar member resides in the front of the toilet bowl said sufficient distance accessible by the front of the foot of a bathroom user regardless of their posture when using the toilet.

3. The toilet seat lifting device of claim 1, wherein said first support frame member resides on one side of the toilet bowl and said second support fame member resides on the other side of the toilet bowl wherein said first and second support frame members are parallel to the floor when in a non-lifting position.

4. The toilet seat lifting device of claim 1, wherein said lifting arm comprises:

an elongated shaft member having one end rotatably coupled to said first support frame member; and, an extension shaft member having one end perpendicularly coupled to the other distal end of said elongated shaft member and the other end coupled to a bracket member wherein said bracket member is coupled to an underside of said toilet seat.

5. The toilet seat lifting device of claim 4, further comprising:

a first stanchion coupled to said first support frame member wherein said first support frame member is pivotally coupled to said first stanchion via a first pivot pin; and a second stanchion coupled to said second support frame member wherein said second support frame member is pivotally coupled to said second stanchion via a second pivot pin.

6. The toilet seat lifting device of claim 5, wherein as foot pressure is applied to said foot pedal to raise the toilet seat, a front portion of said first and second support frame members pivot downward and as a back portion of said first support frame member pivots upward about said first pivot pin, said elongated shaft member of said lifting arm is lifted upward and said bracket member rotates about said extension shaft member into a substantially vertical position.

7. A toilet seat lifting device for lifting and lowering a toilet seat of a toilet automatically, for use by men and women, comprising:

a his and her foot pedal having a first bar member recessed under a toilet bowl of the toilet and an arch-shaped member coupled to said first bar member wherein said arch-shaped member is offset to the side from the center of the front of the toilet and extends beyond the toilet bowl a sufficient distance accessible by the front of a foot of a bathroom user as the bathroom user stands directly in front of the toilet and as the bathroom user squats down over the toilet bowl;

a first support frame member coupled to said arch-shaped member;

a second support frame member parallel to said first support frame member and perpendicularly coupled to said first bar member; and, a lifting arm member coupled to said toilet seat and to said first support frame member.

8. The toilet seat lifting device of claim 7, said arch-shaped member comprises:

a second bar member perpendicularly coupled to said first support frame member; and, a third bar member perpendicularly coupled to said first and second bar members wherein said second bar member is distanced from said first bar member by the length of said third bar member and wherein said second bar member resides in the front of the toilet bowl said sufficient distance accessible by the front of the foot of a bathroom user regardless of their posture when using the toilet.

9. The toilet seat lifting device of claim 7, wherein said first support frame member resides on one side of the toilet bowl and said second support fame member resides on the other side of the toilet bowl wherein said first and second support frame members are parallel to the floor when in a non-lifting position.

10. The toilet seat lifting device of claim 7, wherein said lifting arm comprises:

an elongated shaft member having one end rotatably coupled to said first support frame member; and, an extension shaft member having one end perpendicularly coupled to the other distal end of said elongated shaft member and the other end coupled to a bracket member wherein said bracket member is coupled to an underside of said toilet seat.

11. The toilet seat lifting device of claim 10, further comprising:

a first stanchion coupled to said first support frame member wherein said first support frame member is pivotally coupled to said first stanchion via a first pivot pin; and a second stanchion coupled to said second support frame member wherein said second support frame member is pivotally coupled to said second stanchion via a second pivot pin.

12. The toilet seat lifting device of claim 11, wherein as foot pressure is applied to said foot pedal to raise the toilet seat, a front portion of said first and second support frame members pivot downward and as a back portion of said first support frame member pivots upward about said first pivot pin, said elongated shaft member of said lifting arm is lifted upward and said bracket member rotates about said extension shaft member into a substantially vertical position.

13. A toilet seat lifting device for lifting and lowering a toilet seat of a toilet automatically, for use by men and women, comprising:

a his and her foot pedal having a first bar member recessed under a toilet bowl of the toilet and an arch-shaped member coupled to said first bar member wherein said arch-shaped member extends beyond the toilet bowl a sufficient distance and is offset to the side from the center of the front of the toilet, said arch-shaped member comprises:

a second bar member perpendicularly coupled to said first support frame member, and a third bar member perpendicularly coupled to said first and second first bar members wherein said second bar member is distanced from said first bar member by the length of said third bar member and wherein said second bar member resides in the front of the toilet bowl a sufficient distance accessible by the foot of the bathroom user regardless of their posture when using the toilet;

a first support frame member coupled to said arch-shaped member;

a second support frame member parallel to said first support frame member and perpendicularly coupled to said first bar member; and, a lifting arm member coupled to said toilet seat and to said first support frame member.

14. The toilet seat lifting device of claim 13, wherein said first support frame member resides on one side of the toilet bowl and said second support fame member resides on the other side of the toilet bowl wherein said first and second support frame members are parallel to the floor when in a non-lifting position.

15. The toilet seat lifting device of claim 13, wherein said lifting arm comprises:

an elongated shaft member having one end rotatably coupled to said first support frame member; and, an extension shaft member having one end perpendicularly coupled to the other distal end of said elongated shaft member and the other end coupled to a bracket member wherein said bracket member is coupled to an underside of said toilet seat.

16. The toilet seat lifting device of claim 15, further comprising:

a first stanchion coupled to said first support frame member wherein said first support frame member is pivotally coupled to said first stanchion via a first pivot pin; and a second stanchion coupled to said second support frame member wherein said second support frame member is pivotally coupled to said second stanchion via a second pivot pin.

17. The toilet seat lifting device of claim 16, wherein as foot pressure is applied to said foot pedal to raise the toilet seat, a front portion of said first and second support frame members pivot downward and as a back portion of said first support frame member pivots upward about said first pivot pin, said elongated shaft member of said lifting arm is lifted upward and said bracket member rotates about said extension shaft member into a substantially vertical position.

* * * * *